US007669634B2

(12) United States Patent
Sugiyama et al.

(10) Patent No.: US 7,669,634 B2
(45) Date of Patent: Mar. 2, 2010

(54) SLIDING ROLL SCREEN DOOR

(75) Inventors: Noboru Sugiyama, Shizuoka (JP); Takashi Moriya, Suginami-ku (JP)

(73) Assignees: Seiki Juko Co., Ltd., Shizuoka-shi (JP); Seiko Sogyo Co., Ltd., Tokyo (JP)

( * ) Notice: Subject to any disclaimer, the term of this patent is extended or adjusted under 35 U.S.C. 154(b) by 427 days.

(21) Appl. No.: 11/629,198

(22) PCT Filed: Jun. 14, 2004

(86) PCT No.: PCT/JP2004/008326

§ 371 (c)(1),
(2), (4) Date: Dec. 12, 2006

(87) PCT Pub. No.: WO2005/121487

PCT Pub. Date: Dec. 22, 2005

(65) Prior Publication Data

US 2008/0060771 A1 Mar. 13, 2008

(51) Int. Cl.
*A47G 5/02* (2006.01)

(52) U.S. Cl. ..... 160/242; 160/26; 160/99; 160/313; 160/315; 160/323.1; 160/206; 242/384.7; 242/385.4

(58) Field of Classification Search ..... 160/242, 160/243, 245, 246, 248, 26, 99, 313, 315, 160/318, 323.1, 24, 306; 242/384.7, 385.4
See application file for complete search history.

(56) References Cited

U.S. PATENT DOCUMENTS 4,228,843 A * 10/1980 Kobayashi ..... 160/306
4,359,081 A * 11/1982 Brower ..... 160/243
5,205,332 A * 4/1993 Lii ..... 160/23.1
5,226,467 A * 7/1993 Lii ..... 160/302
5,505,244 A * 4/1996 Thumann ..... 160/23.1
5,542,464 A * 8/1996 Shiina ..... 160/296
5,687,506 A * 11/1997 Davies et al. ..... 49/260
5,946,857 A * 9/1999 Davies et al. ..... 49/260
5,961,172 A * 10/1999 Ament et al. ..... 296/37.16
6,059,007 A * 5/2000 Tomita ..... 160/242

(Continued)

FOREIGN PATENT DOCUMENTS

JP 2572923 5/1998

(Continued)

*Primary Examiner*—Katherine W Mitchell
*Assistant Examiner*—Philip S Kwon
(74) *Attorney, Agent, or Firm*—Oblon, Spivak, McClelland, Maier & Neustadt, L.L.P.

(57) ABSTRACT

A horizontal-pulling roll screen door for which the right/left hand can be set or changed easily and safely even by a layman and in a screen door in which a net wound up by a winding shaft of a movable stile is made capable of opening/closing by horizontal pulling. First and second caps rotatably supporting the winding shaft are mounted at the both ends of the movable stile capable of replacement by each other. A lock mechanism which can hold a locked state as necessary is provided between a connecting cylindrical shaft connected to the winding shaft and an intermediate support member connected to the first or the second cap unrotatably and removably. Rotation of the winding shaft by an urging force of a winding spring is prevented by this lock mechanism even when the both caps are removed for assembling or change of the right/left hand.

11 Claims, 9 Drawing Sheets

U.S. PATENT DOCUMENTS

| | | | | |
|---|---|---|---|---|
| 6,209,610 | B1 * | 4/2001 | Davies et al. | 160/26 |
| 6,405,781 | B2 * | 6/2002 | Davies et al. | 160/23.1 |
| 6,446,696 | B1 * | 9/2002 | Davies et al. | 160/243 |
| 6,463,983 | B1 * | 10/2002 | Lang | 160/23.1 |
| 6,478,070 | B2 * | 11/2002 | Poppema | 160/23.1 |
| 6,701,994 | B2 * | 3/2004 | Goldenberg et al. | 160/31 |
| 6,749,142 | B2 * | 6/2004 | Arisaka et al. | 242/381 |
| 6,782,938 | B2 * | 8/2004 | Colson et al. | 160/121.1 |
| 6,814,127 | B2 * | 11/2004 | Tagtow et al. | 160/31 |
| 6,938,667 | B2 * | 9/2005 | Sugiyama et al. | 160/296 |
| 7,147,030 | B2 * | 12/2006 | Dalle Nogare et al. | 160/315 |
| 7,370,685 | B2 * | 5/2008 | Moriya et al. | 160/290.1 |
| 7,395,850 | B2 * | 7/2008 | Chino et al. | 160/243 |
| 7,438,112 | B2 * | 10/2008 | Cheng | 160/24 |
| 2002/0163220 | A1 * | 11/2002 | Ament et al. | 296/37.16 |
| 2004/0261958 | A1 * | 12/2004 | Sugiyama et al. | 160/296 |
| 2005/0230065 | A1 * | 10/2005 | Moriya et al. | 160/271 |
| 2007/0056698 | A1 * | 3/2007 | Lin | 160/313 |
| 2008/0092454 | A1 * | 4/2008 | Moriya et al. | 49/505 |

FOREIGN PATENT DOCUMENTS

| | | |
|---|---|---|
| JP | 2004 003204 | 1/2004 |
| JP | 3 532 805 | 5/2004 |

* cited by examiner

SLIDING ROLL SCREEN DOOR

TECHNICAL FIELD

The present invention relates to a roll screen door capable of opening/closing by horizontally pulling a net and more specifically to a horizontal-pulling roll screen door in which right/left sides of opening/closing is made easily changeable in a net of a horizontal-pulling screen door constructed to be wound up by an urging force of a spring around a winding shaft extended between a side frame and a movable stile in a screen door frame and supported by the movable stile.

BACKGROUND ART

A horizontal-pulling roll screen door in which a net is extended capable of being opened/closed horizontally to be wound up by an urging force of a spring around a winding shaft supported rotatably by a movable stile between a side frame and a movable stile in a screen door frame is publicly known as disclosed in Japanese Unexamined Patent Application Publication No. 2002-168070, for example.

Also, when a right/left sides of a horizontal-pulling screen door are to be set or changed according to the door of a building opening, it has been known that the screen door is reversed front and back with the vertical orientation unchanged or upside down with the horizontal orientation unchanged.

However, in many of the horizontal-pulling roll screen doors in the above type of winding up a net around a winding shaft of the movable stile, the front and back appearances are not symmetrical or the shapes of caps mounted to the upper and the lower ends of the movable stile are different, and their left/right sides can not be changed only by reversing the screen door front and back or upside down. Then, some disassembly and reassembly are needed to make the right/left sides changeable. Moreover, since the winding shaft for winding up the net by the urging force of the spring is housed in the movable stile, the urging force of the spring might be released at disassembly, which involves danger for those not skilled.

Moreover, for the conventional horizontal-pulling roll screen door, if an external force such as wind acts on the net in the net extended state, the winding shaft is rotated by the external force against the urging force of the spring in the direction to feed out the net remaining therein. As a result, the net is extended in the arc state and removed from the upper and the lower lateral frames of the screen door, and insect proof performance can not be necessarily kept favorably, which is a problem. In order to solve this problem, it is preferable to add winding-shaft fixing means for disabling rotation of the winding shaft when extending the net, but when the right/left sides of the above net opening/closing is to be changed, the change of the right/left sides should be able to be changed, including this fixing means.

DISCLOSURE OF THE INVENTION

An object of the present invention is to solve the above problem and to provide a horizontal-pulling roll screen door in which a net wound up by an urging force of a spring around a winding shaft supported by a movable stile between a side frame and the movable stile in a screen door frame in which the right/left sides can be set or changed easily and safely.

Another object of the present invention is to provide a horizontal-pulling roll screen door in which the right/left sides can be set or changed easily and safely even by a layman without using any special tools.

Another object of the present invention is to provide a horizontal-pulling roll screen door to which winding shaft fixing means is added for suppressing arc-state extension of the net due to action of an external force such as wind on the net in the net extended state, the right/left sides of opening/closing of the net can be changed, including the fixing means.

In order to solve the above problem, the present invention is characterized in that, in a horizontal-pulling roll screen door in which a net extended between a side frame and a movable stile in a screen door frame is wound up by an urging force of a spring around a winding shaft accommodating the coil-state winding spring therein rotatably supported by the movable stile so that the net can be opened/closed by horizontal pulling, the movable stile has a first and a second caps rotatably supporting the winding shaft detachably mounted at both an upper and a lower ends of a case accommodating the winding shaft, at least the first cap mounted at the upper end of the case is slidably supported by an upper rail of the screen door frame, and the movable stile except the first and the second caps, the net wound up around the winding shaft and the side frame fixed to the other end of the net are constructed so as to form an outer shape in substantially vertical symmetry so that the first and the second caps can be replaced by each other, the winding spring accommodated inside the winding shaft has its one end connected to the winding shaft and the other end fixed to an intermediate support member unrotatably and removably connected to the first or the second cap, and a lock mechanism is provided between a connecting cylindrical shaft connected to one end of the winding shaft and the intermediate support member for temporarily disabling their relative rotation.

In the horizontal-pulling roll screen door of the present invention having the above construction, since the outer shape of the movable stile including the first and the second caps, the net wound up around the winding shaft in the movable stile and the side frame fixed to the net end are made in the substantially vertical symmetry so that the first and the second caps at the both ends of the movable stile can be replaced by each other, the right/left sides in opening/closing of the screen door which can be opened/closed by horizontal pulling of the net wound up by the urging force of the spring around the winding shaft supported by the movable stile can be freely set or changed according to an opening of a door of a building, and there is no need to use a special tool. Moreover, the net is wound up by the urging force of the spring around the winding shaft supported by the movable stile, but since the winding shaft is prevented from being rotated by holding the urging force of the spring in the locked state by the lock mechanism provided between the intermediate support member and the connecting cylindrical shaft, even if the first and the second caps are removed from both ends of the movable stile in the state where a rotational urging force is accumulated in the winding spring, the net is not wound up. Therefore, installing the screen door or changing the right/left sides can be done safely and easily by switching the first and the second caps at both ends of the movable stile with each other.

When the lock mechanism is brought into the non-locked state, the rotational urging force of the winding spring acts on the winding shaft to wind up the net, and when the movable stile is moved in the direction to withdraw the net, the rotational urging force is accumulated in the winding spring.

In the preferred embodiment of the roll screen door of the present invention, the lock mechanism is constructed so that a lock lever is rotatably supported by a support pin in an opening provided at the connecting cylindrical shaft and an engagement portion is provided at the base end of the lock lever to be engaged with any of a large number of recess portions provided on the outer circumference of the intermediate support member by rotational movement of the lever to a standing locked position. By this lock lever, the rotation can be locked by the connecting cylindrical shaft and the winding spring of the winding shaft at the locked position. Moreover, since the lock mechanism can be easily brought into the locked state or the locked state can be released only by rotationally moving the lock lever, the right/left hand of the horizontal-pulling roll screen door can be changed easily and safely even by a layman without requiring any special tools.

In the preferred embodiment of the horizontal-pulling roll screen door of the present invention, a cylindrical member provided with a pinion rotated in conjunction with the winding shaft is supported by at least one of the first and the second caps, and a rack meshed with the pinion and rotating the winding shaft in the feed-out direction of the net is provided on a face opposite to the pinion in the lateral frame of the screen door frame at a portion opposite to the pinion including the fully extended state or a state immediately before the fully extended state of the net.

By this construction, when the movable stile is at the position where the net is fully extended, the pinion fixed to the winding shaft is meshed with the rack of the lateral frame of the screen door frame. Thus, even if an external force such as wind acts on the net, rotation of the winding shaft in the net feed-out direction pulled by the net can be suppressed. It is preferable that the outer diameter of the pinion is formed larger than the outer diameter of the winding shaft in order to keep the extended net in the tensioned state as much as possible.

Moreover, in the preferred embodiment of the present invention, the cylinder member is constructed by the pinion and a fitting portion integral with the pinion, and the fitting portion is constructed so that it is unrotatably and removably connected to the connecting cylindrical shaft connected to the winding shaft and the other end of the winding shaft, respectively. By this construction, in the horizontal-pulling roll screen door in which winding shaft fixing means for suppressing extension of the net in the arc-state due to action of the external force such as wind on the net in the net extended state, that is, the pinion and the rack are provided, the right/left sides in opening/closing of the net can be changed including the fixing means.

Also, in the preferred embodiment of the horizontal-pulling roll screen door of the present invention, the first cap has a head portion to which the track roller is rotatably mounted, the connecting cylinder portion detachably connectable to either an upper and a lower ends of a case of the movable stile whose sectional shape is constant, a shaft support portion inward the connecting cylinder portion for rotatably supporting the winding shaft or a member connected to it, and a tip end shaft portion in the spline shaft state extending from the tip end of the shaft support portion, and the second cap has a connecting cylinder portion which can be detachably connected to either the upper and the lower ends of the case, a shaft support portion inward in the connecting cylinder portion for rotatably supporting the winding shaft or a member connected to it, and a tip end shaft portion in the same spline shaft state as the tip end shaft portion in the first cap extending from the tip end of the shaft support portion, and each of the tip end shaft portions of the first and the second caps are constructed unrotatably and capable of removal with respect to the intermediate support member. As a member rotatably supported by the shaft support portions of the both caps and connected to the winding shaft, a cylinder member is usually used having a pinion and a fitting portion integral with it, in which the fitting portion is connected to the winding shaft through the connecting cylindrical shaft.

Moreover, in the present invention, it is preferable that by providing a recess groove fitted with a projection streak provided on the surface of the fitting portion of the cylinder member inside the end of the connecting cylinder shaft, they are connected unrotatably and removably, and the same recess groove as the end inner surface of the connecting cylinder shaft is provided on the inner surface of the end of the winding shaft so that it can be connected to the fitting portion of the cylinder member unrotatably and removably and the fitting portion of the cylinder member and the winding shaft are supported rotatably and removably with respect to the shaft support portion of the second cap.

REFERENCE NUMERALS

Figure 1:
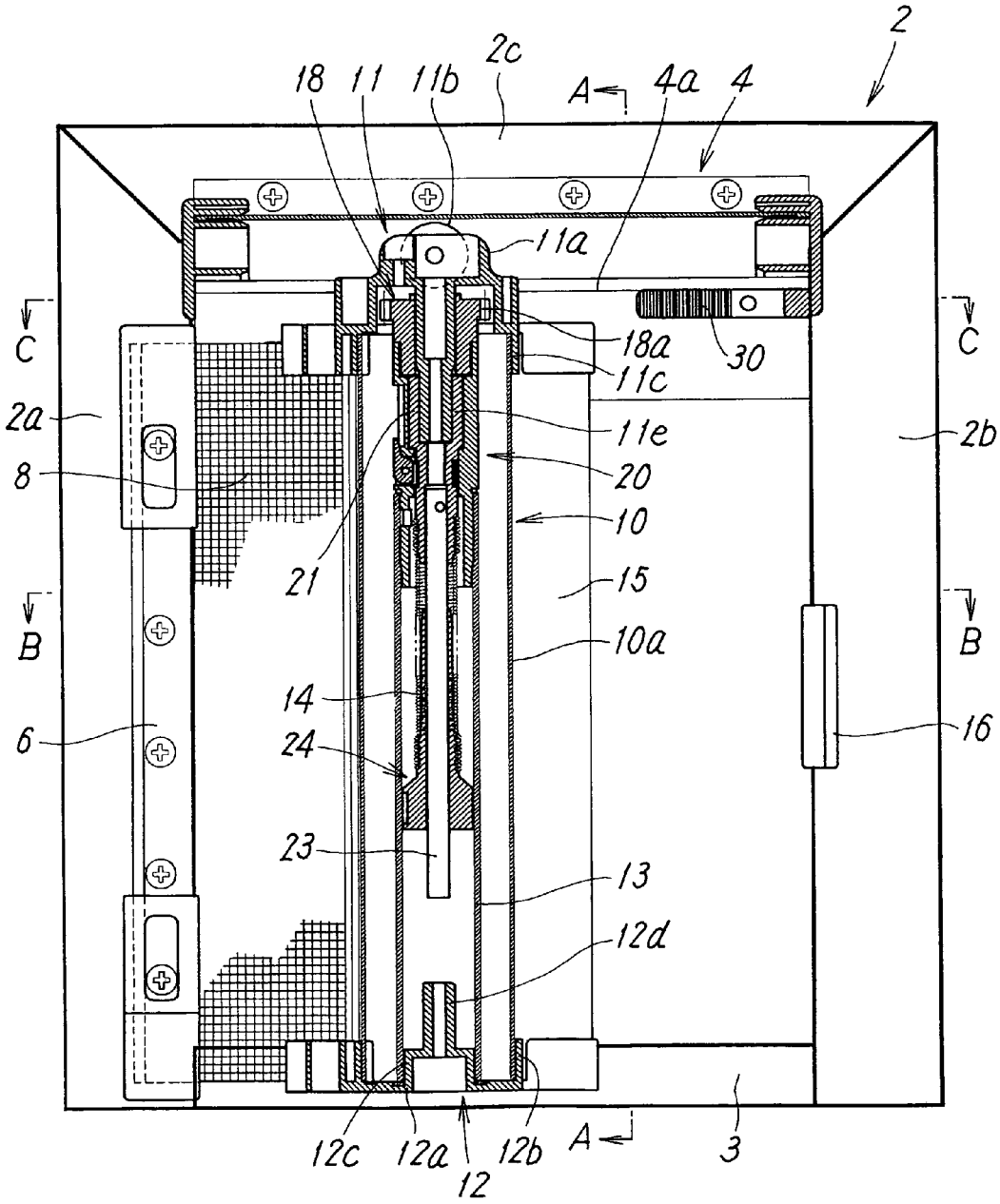
FIG. 1 is a front sectional view showing an embodiment of a horizontal-pulling roll screen door according to the present invention.

2 Building opening frame
2*a*, 2*b* Opening side frame
2*c* Opening upper frame
3 Sash lower frame
3*a* Lower rail
4 Upper rail
4*a* Rolling face
6 Side frame
8 Net
10 Movable stile
10*a* Case
10*b* Opening
10*c* Guide member
10*d* Guide groove
11 First cap
11*a* Head portion
11*b* Track roller
11*c* Connecting cylinder portion
11*d* Shaft support portion
11*e* Tip end shaft portion
12 Second cap
12*a* Bottom portion
12*b* Connecting cylinder portion
12*c* Shaft support portion,

12*d* Tip end shaft portion
13 Winding shaft
13*a* Recess groove
14 Winding spring
15 Hook
16 Locking member
16*a* Locking portion
18 Cylinder member
18*a* Pinion
18*b* Fitting portion
20 Connecting cylindrical shaft
20*a* Recess groove
20*b* Fitting cylinder portion
20*c* Projection streak
20*d* Opening
21 Intermediate support member
21*a* Fitting portion
21*b* Engagement groove
21*c* Shaft portion
21*d* Recess portion
21*e* Spring receiving portion
21*f* Helical groove
23 Spring shaft
24 Spring receiver
24*a* Helical groove
24*b* Projection streak
25 Pin
26 Support pin
27 Lock lever
27*a* Engagement portion
30 Rack
35 Handle

BEST MODE FOR CARRYING OUT THE INVENTION

The attached drawings show an embodiment of the horizontal-pulling roll screen door according to the present invention.

Figure 2:
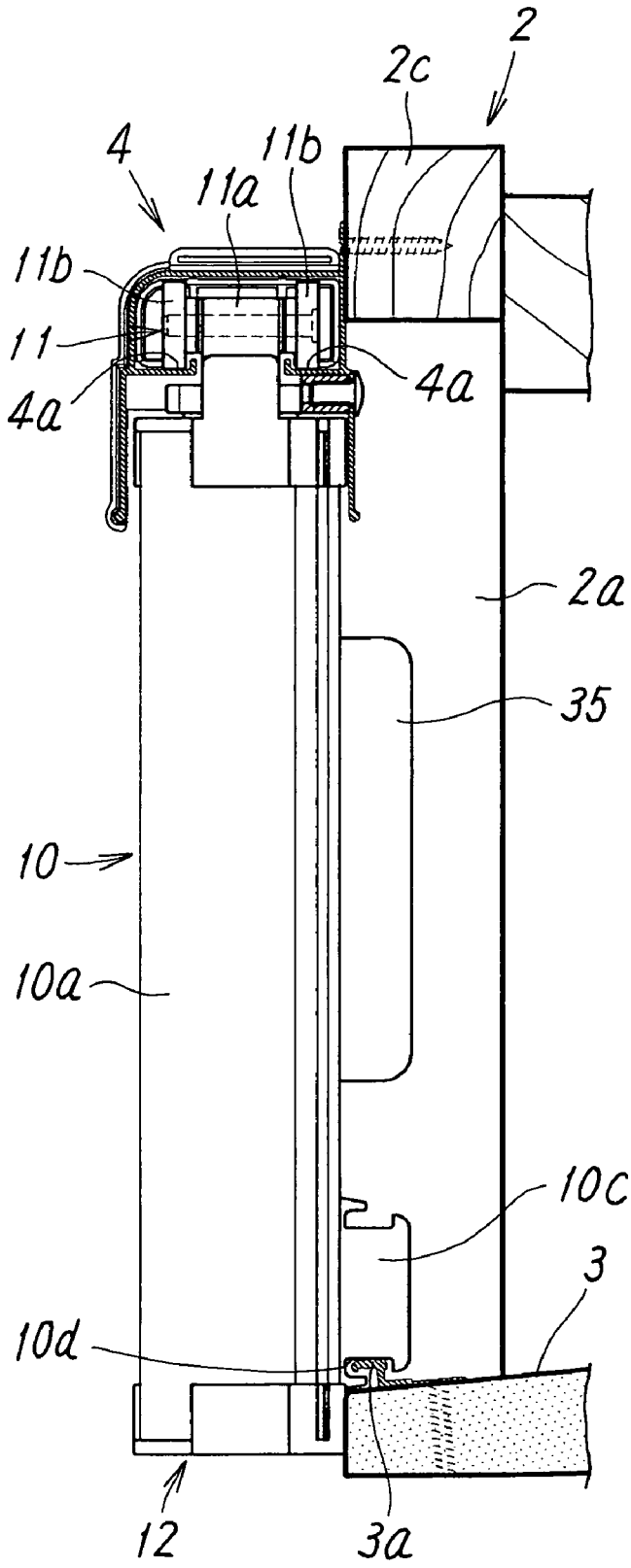
FIG. 2 is a sectional view in A-A line in FIG. 1.
Figure 3:
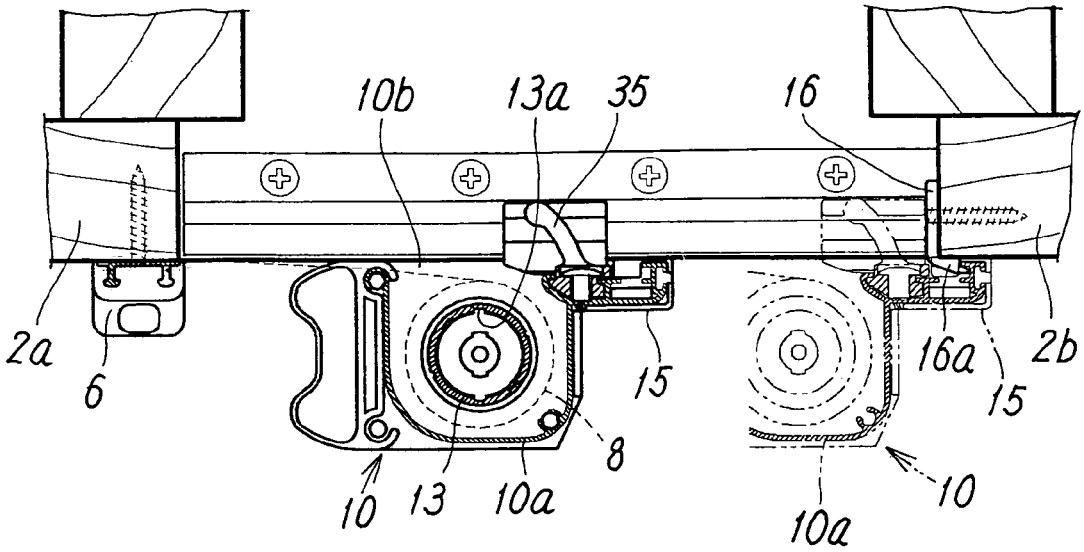
FIG. 3 is a sectional view in B-B line in FIG. 1.

This horizontal-pulling roll screen door is, as shown in FIGS. 1 to 3, to be used by being mounted at a building opening frame 2, and the right/left sides in opening/closing of the net can be set arbitrarily at installation of the screen door or can be changed as appropriate after the installation. The building opening frame 2 is provided with right and left opening side frames 2*a*, 2*b* and an opening upper frame 2*c* and a lower frame is provided when necessary. But here, such a case is shown where a lower frame 3 of a sash installed at the building opening is used to hold the screen door.

As the screen door frame to be mounted to the building opening frame 2, at least an upper rail 4 as a lateral frame mounted to the opening upper frame 2*c* of the building opening frame 2 and a side frame 6 fixed to one opening side frame 2*a* to hold one end of a net 8 of the roll screen door are provided. Also, a winding shaft 13 for winding up the other end of the net 8 is housed inside a case 10*a* of a movable stile 10, and the winding shaft 13 is rotatably supported between a first and a second caps 11, 12 provided at an upper and a lower ends of the case 10*a* of the movable stile 10. The case 10*a* has an opening 10*b* having a constant sectional shape for leading out or the like of the net 8 on the building opening frame 2 side. This movable stile 10 is suspended movably on a rolling face 4*a* provided on the upper rail 4 through a pair of track rollers 11*b* rotatably mounted to a head portion 11*a* of the first cap 11.

A side frame opposite to the side frame 6 may be provided on the opening side frame 2*b* of the building opening frame 2, but as shown in FIG. 3, a locking member 16 provided with a locking portion 16*a* for locking a hook 15 provided at the movable stile 10 may be directly mounted to the opening side frame 2*b*. In this case, when considering change of the right/left sides after installation of the screen door, it is necessary to detachably mount the locking member 16 by fastening means such as a screw. When a side frame opposite to the side frame 6 is to be provided, the locking member 16 is provided on it, but in this case, too, it is necessary to make the side frame detachable as necessary.

Figure 5:
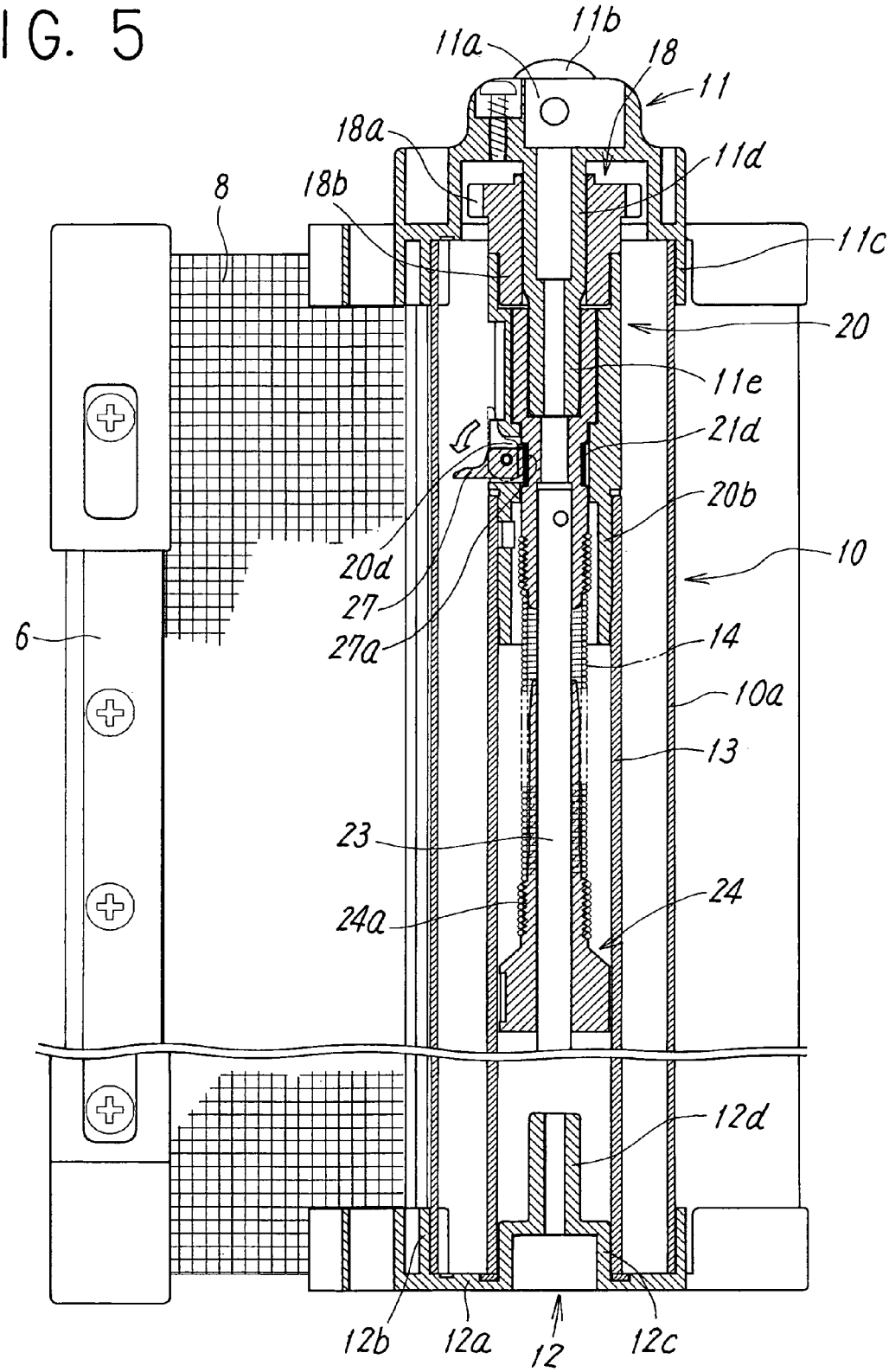
FIG. 5 is an enlarged partial sectional view of an essential part of FIG. 1.

The horizontal-pulling roll screen door is, as shown in FIGS. 1 and 5, constructed as a winding box in which the movable stile 10 accommodates the winding shaft 13 in its outline. The winding shaft 13 is rotatably supported by a movable stile 10 through the first cap 11 and the second cap 12, and the net 8 having one end mounted to the winding shaft 13 is wound up by an urging force of a winding spring 14 in the coil state accommodated inside the winding shaft 13, and the other end of the net 8 is mounted to the side frame 6 so that the net 8 can be extended by horizontal pulling between the side frame 6 and the movable stile 10.

When the construction of the movable stile 10 is described in more detail, the first cap 11 has, as shown in FIGS. 1 and 2, the head portion 11*a* to which the pair of track rollers 11*b* are rotatably mounted, a connecting cylinder portion 11*c* which can be detachably mounted to either of the upper and the lower ends of the case 10*a* of the movable stile 10 with a constant sectional shape as clearly shown in FIG. 5, a shaft support portion lid located inward the connecting cylinder portion 11*c* and disposed coaxially with that, and a tip end shaft portion 11*e* in the spline shaft state extending from the tip end of the shaft support portion lid, and rotation of the first cap 11 itself around the center axis thereof is restrained by contact with the upper rail 4, and the track rollers 11*b* are loaded capable of rolling along the rolling face 4*a* of the upper rail 4.

Also, the second cap 12 has a connecting cylinder portion 12*b* standing from a bottom portion 12*a* and capable of being detachably mounted to either of the upper and the lower ends of the case 10*a* of the movable stile 10 as with the connecting cylinder portion 11*c* of the first cap 11, a shaft support portion 12*c* located inwards from the connecting cylinder portion 12*b* and rotatably supporting the winding shaft 13, and a tip end shaft portion 12*d* in the spline shaft state protruding from the tip end of the shaft support portion 12*c*. The circumferential face shape of this tip end shaft portion 12*d* is the same as that of the tip end shaft portion 11*e* in the first cap 11.

In this second cap 12, its connecting cylinder portion 12*b* is fitted to the case 10*a* with a variant section, and the rotation around the center axis is suppressed similarly to the first cap 11, but as shown in FIG. 2, a guide member 10*c* having a guide groove 10*d* on the side wall of the case 10*a* is provided at a position proximate to the second cap 12 in the case 10*a* of the movable stile 10 and the guide groove 10*d* is slidably engaged with a lower rail 3*a* provided on the upper face of the sash lower frame 3 to perform guiding. And in this point, too, the rotation of the second cap is suppressed.

When the case 10*a* of the movable stile 10 is to be reversed upside down to change the right/left sides in opening/closing of the screen door, it is necessary to attach the guide member 10*c* to the other end of the case 10*a*, and thus, it is necessary that mounting of the guide member 10*c* to the case 10*a* should be detachable. The guide member 10*c* may be provided at the second cap 12. In this embodiment, the lower end of the net 8 is also brought into contact with the side face of the sash lower frame 3 similarly to the movable stile 10 for guiding.

The first cap 11 and the second cap 12 can be replaced by each other, but as can be seen from FIGS. 9 and 10, which will be described later, when the movable stile 10, the net and the like are reversed upside down to change the right/left sides in opening/closing of the net, the right/left orientation of the first and the second caps 11, 12 should be also changed and thus, the front and rear are formed substantially in the symmetrical shape in FIG. 550 that they can be attached to the case 10*a* even if the orientation is changed. However, if the case 10*a* is in the shape to which the first and the second caps 11, 12 can be attached even if their orientation is changed, there is no need to make both caps 11, 12 in the symmetrical shape as described above.

Figure 4:
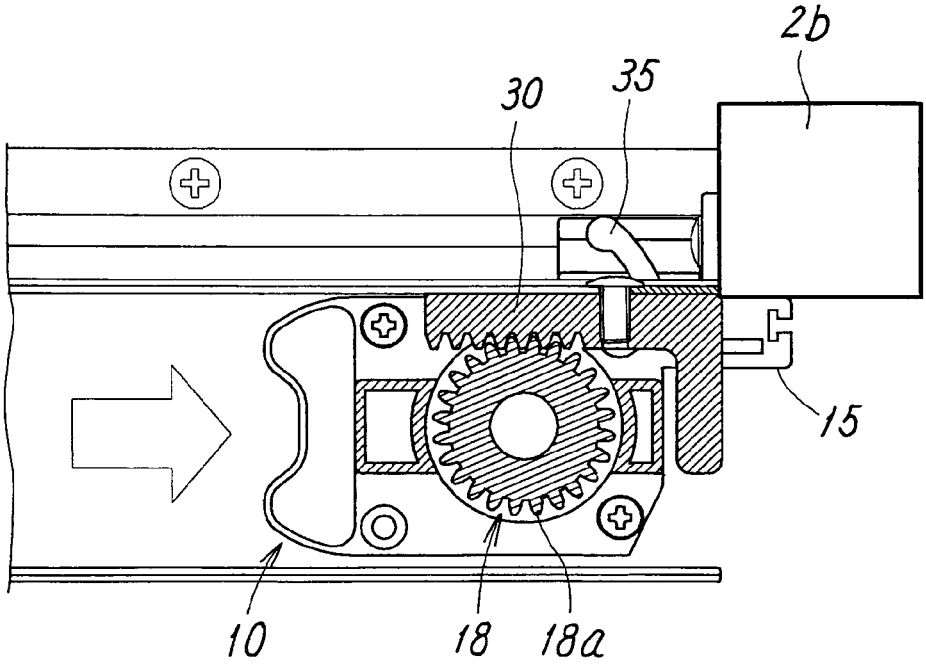
FIG. 4 is a sectional view showing a meshed state of a pinion and a rack in C-C position in FIG. 1.

As clearly shown in FIGS. 4 and 5, to the shaft support portion lid of the first cap 11, a fitting portion 18*b* of a cylinder member 18 attached with a pinion 18*a* on the circumference is rotatably fitted, and the winding shaft 13 is connected to the cylinder member 18 through a connecting cylindrical shaft 20 so that it makes integral rotation.

Figure 8:
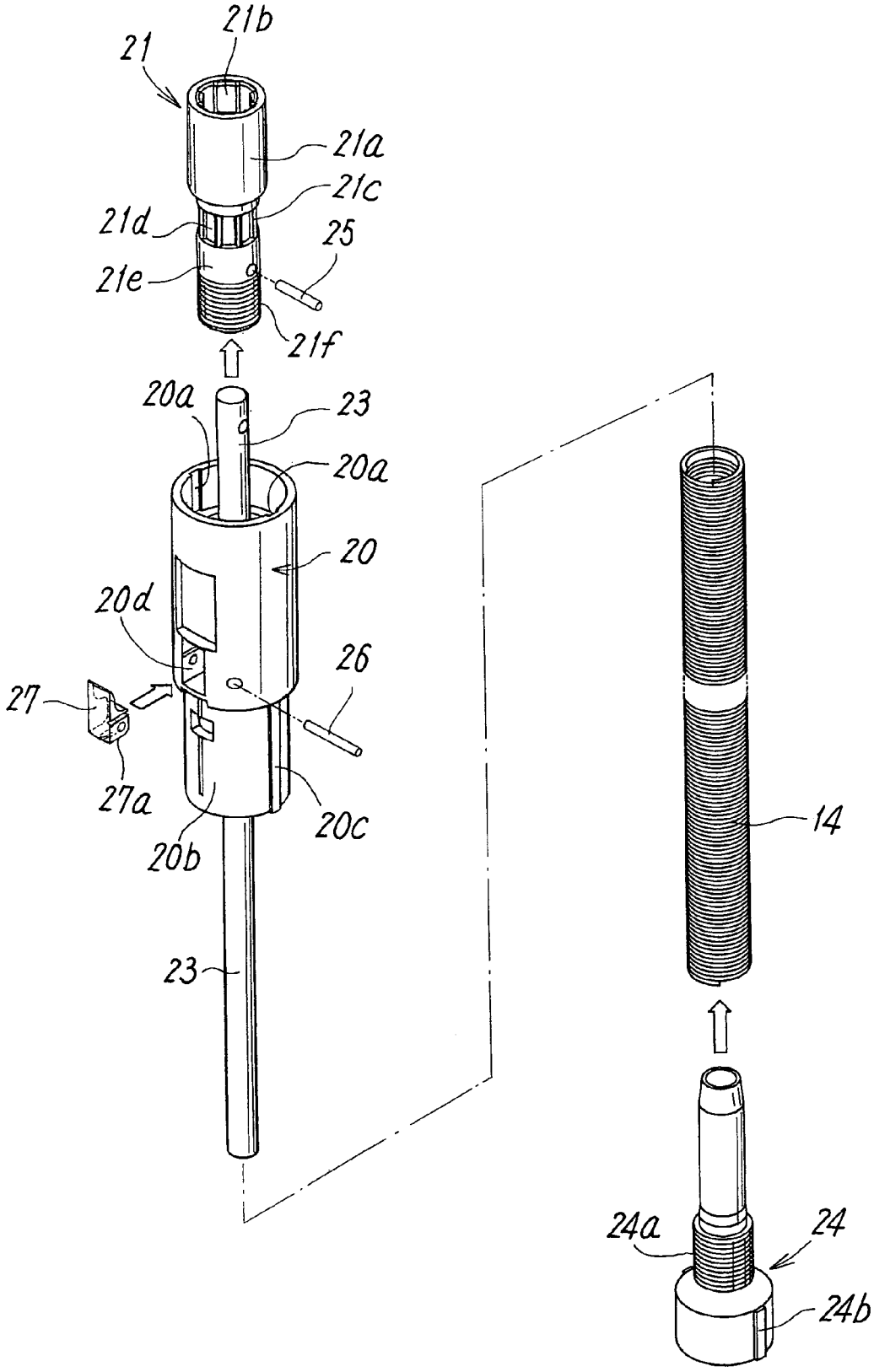
FIG. 8 is an exploded enlarged perspective view showing an internal structure of a winding shaft.

That is, in the connecting cylindrical shaft 20, as shown in FIG. 8, a recess groove 20*a* is provided on the inner surface of its end and by fitting the recess groove 20*a* with a projection streak (not shown) fitted with the recess groove 20*a* provided on the surface of the fitting portion 18*b* of the cylinder member 18, they are connected detachably but unrotatably with respect to each other. Fixing of the winding shaft 13 to the connecting cylindrical shaft 20 is also carried out by fitting of the projection streak 20*c* in the fitting cylinder portion 20*b* in the connecting cylindrical shaft 20 with the same shaped recess groove 13*a* (See FIG. 3) extending in the axial direction of the winding shaft 13. Therefore, the winding shaft 13 is rotatably supported by the shaft support portion lid of the first cap 11 through the connecting cylinder portion 20 and the cylinder member 18. Also, the other end of the winding shaft 13 is rotatably supported by the shaft support portion 12*c* of the second cap 12.

To the tip end shaft portion 11*e* in the spline shaft state extending from the tip end of the shaft support portion 11*d* in the first cap 11, as shown in FIGS. 5 to 8, a fitting portion 21*a* of an intermediate support member 21 having an engagement groove 21*b* splined-fitted with the shaft portion 11*e* on the inner surface is fitted in capable of insertion/withdrawal. The fitting portion 21*a* of the intermediate support member 21 is also capable of spline-connection with the tip end shaft portion 12*d* of the second cap 12 in the same shape as that of the tip end shaft portion 11*e*. Also, the intermediate support member 21 has a large number of recess portions 21*d* with which an engagement portion 27*a* at the base end of a lock lever 27, which will be described later, is engaged around a shaft portion 21*c* continuing to the fitting portion 21*a*, and moreover, a helical groove 21*f* for fixing the end of the winding spring 14 is provided on the outer circumference of a spring receiving portion 21*e* continuing to the shaft portion 21*c* so that the end of the winding spring 14 is screwed/fixed and a spring shaft 23 is inserted into the spring receiving portion 21*e* and it is fixed by a pin 25. Into the tip end of the spring shaft 23, a spring receiver 24 is rotatably and slidably fitted in and the end of the winding spring 14 is fixed to a helical groove 24*a* of the spring receiver 24. This spring receiver 24 has a pair of projection streaks 24*b* extending in the axial direction on its outer circumferential face, and the projection streaks 24*b* are slidably inserted into the recess groove 13*a* (FIG. 3) provided on the inner circumferential face of the winding shaft 13 and extending in the axial direction.

In this way, since the other end of the winding spring 14 having one end fixed to the first cap 11 through the intermediate support member 21 is connected to the winding shaft 13 through the spring receiver 24, when the rotational urging force is accumulated in the winding spring 14, the urging force acts on the winding shaft 13 all the time and if the net 8 is not held against the urging force, the net 8 is wound up.

Figure 9:
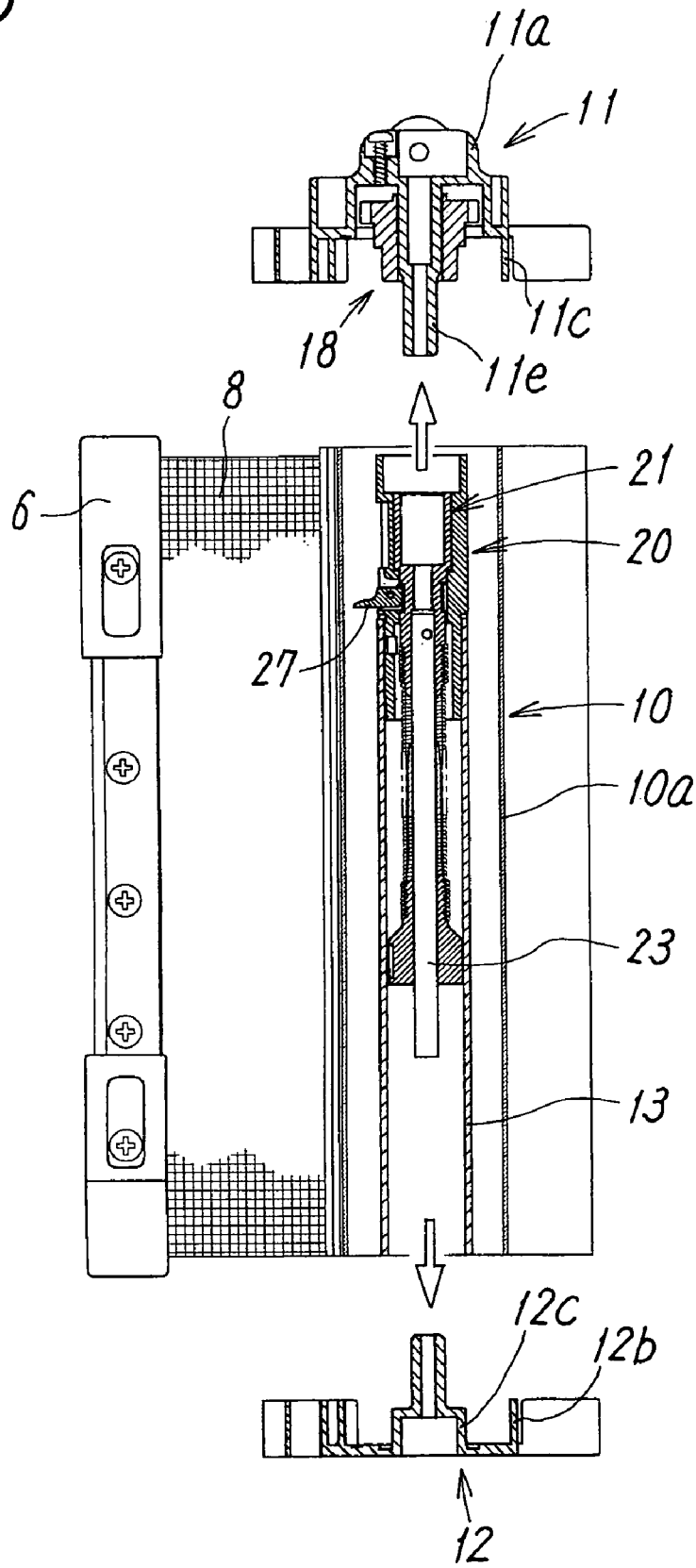
FIG. 9 is an explanatory view showing a state where a first and a second caps are removed from both ends of a movable stile.

Also, the projection streak of the fitting portion 18*b* in the cylinder member 18 can be fitted in the recess groove 13*a* on the inner circumferential face in the shaft end located at the lower end of the winding shaft 13 in the state of FIG. 9 (same as FIG. 5) when the winding shaft 13 is reversed upside down with the connecting cylinder portion 20, the intermediate support member 21 and the like to change the right/left hand in opening/closing of the screen door (See FIGS. 9 and 10), that is, the cylinder member 18 can be directly connected to the winding shaft 13 capable of withdrawal but not rotatable with respect to each other.

The connecting cylinder shaft 20 has, as shown in FIGS. 5 to 8, the lock lever 27 rotatably supported by a support pin 26 in an opening 20*d* provided at a part of the circumferential wall of the connecting cylinder shaft 20 as a lock mechanism of the winding shaft 13, and it is provided with a mechanism that the engagement portion 27*a* at its base end is engaged with any of the large number of recess portions 21*d* provided around the shaft portion 21*c* in the intermediate support member 21 when the lock lever 27 is tilted outward.

Figure 6:
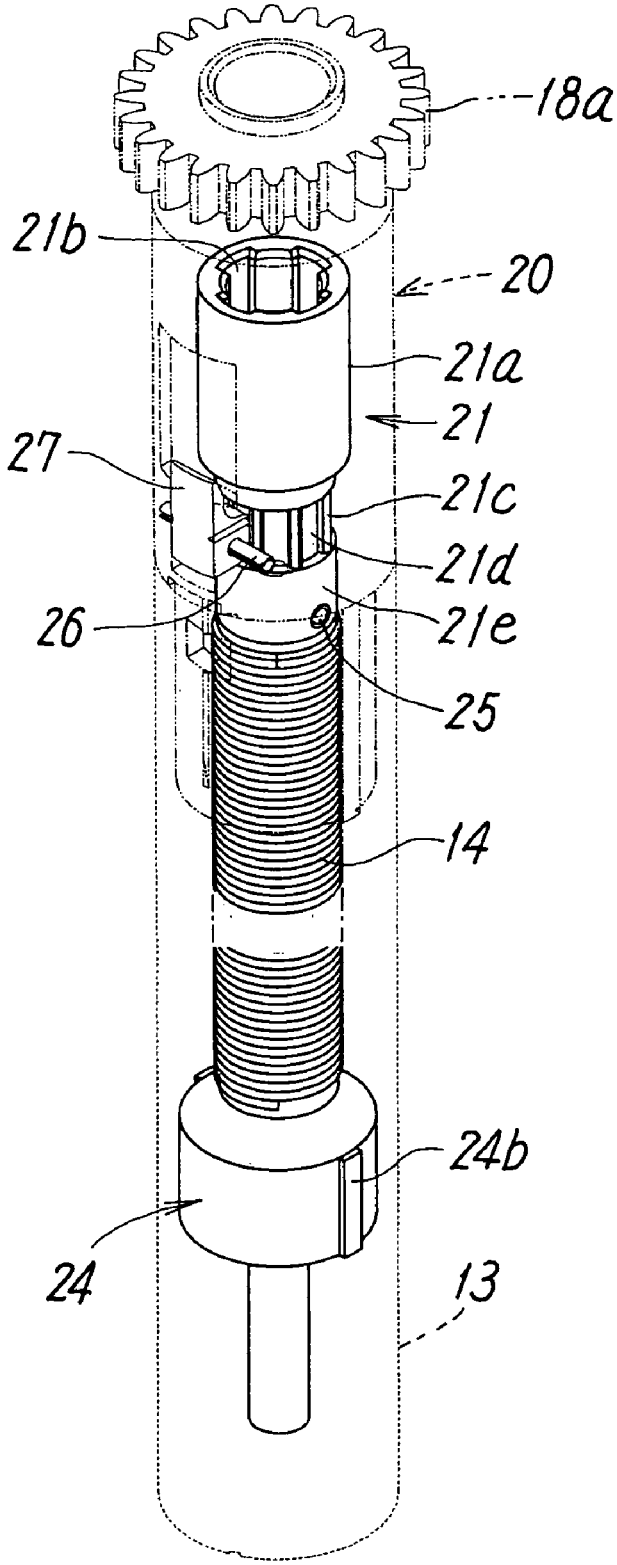
FIG. 6 is a partial enlarged perspective view showing a non-locked state in a lock mechanism of a winding spring.
Figure 7:
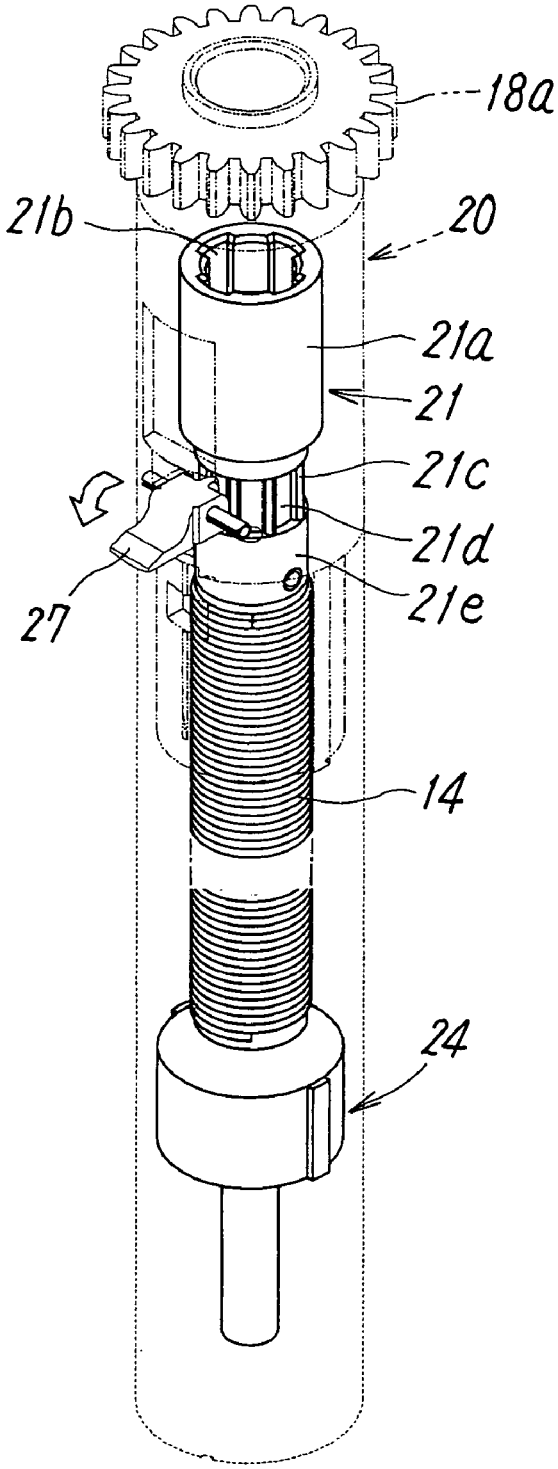
FIG. 7 is a partial enlarged perspective view showing a lock state of the lock mechanism.

In the lock lever 27, as shown in FIG. 7, the engagement portion 27*a* at its base end protrudes toward the intermediate support member 21 side when it is tilted outward and stood on the surface of the winding shaft 13 and engaged with any of the large number of recess portions 21*d* provided on the outer circumference of the intermediate support member 21, and the intermediate support member 21 and the connecting cylindrical shaft 20 connected to the winding shaft 13 are locked so that they can not be rotated with respect to each other. Also, as shown in FIG. 6, when the lock lever 27 is rotated in parallel with the surface of the connecting cylinder shaft 20, engagement between the engagement portion 27*a* at the base end of the lock lever 27 and the recess portion 21*d* on the outer circumference of the intermediate support member 21 is disengaged and the intermediate support member 21 and the connecting cylindrical shaft 20 can be rotated with respect to each other.

In the winding shaft 13, the right/left sides in opening/closing are changed by reversing it upside down, but as can be seen from the above mentioned, the internal mechanism of the winding shaft 13 is not in the vertically symmetrical shape. However, the side frame 6 fixed to the movable stile 10 except the first and the second caps 11, 12, the net 8 wound up by its winding shaft 13 and the end of the net 8 may be constructed with the outer shape in the substantially vertical symmetry so that the first and the second caps 11, 12 can be replaced by each other and the function can be exerted even if the internal mechanism of the winding shaft 13 is reversed upside down and thus, the right/left sides can be changed by reversing of the winding shaft without any trouble.

As can be seen from the above mentioned, in the fully extended state of the net 8, since the urging force is accumulated in the spring 14 incorporated in the winding shaft 13 to extend the net 8, the net 8 is held in the tension state by the maximum urging force of the spring 14, but if the maximum urging force is increased too much, it could incur a problem in operationality, while if the urging force is too small, the net 8 would be expanded to the downwind side by an external force such as wind acting on the net 8.

Then, in order to solve the problem, as shown in FIGS. 1 and 4, at a portion opposite to the pinion including the fully extended state or immediately before that of the net 8 on the face opposite to the pinion 18*a* in the upper rail 4 mounted to the opening upper frame 2*c*, a rack 30 meshed with the pinion 18*a* on the cylinder member 18 rotating in conjunction with the winding shaft 13 is provided, and rotation of the pinion 18*a* meshed with it, that is, of the winding shaft 13 fixed to it is restricted. The rack 30 is disposed so that it is meshed with the pinion 18*a* so as to rotate the winding shaft 13 in the feed-out direction of the net 8 at stretched installation of the net 8. The cylinder member provided with the pinion may be provided also at the second cap 12 side.

Therefore, at the time when the net 8 is almost wound up by the winding shaft 13, the pinion 18*a* of the cylinder member 18 is meshed with the rack 30, and after that, the winding shaft 13 is driven by the pinion 18*a* meshed with the rack 30.

When a range is taken to some degree to restrict the rotation of the winding shaft 13 by meshing between the rack 30 and the pinion 18*a*, if there is a difference between the outer diameter of the pinion 18*a* and the winding diameter of the winding shaft 13, there would be a difference generated between the movement amount of the winding shaft 13 and the feed-out amount of the net 8 within the meshing range. That is, if the diameters of the both are substantially the same, the movement amount of the winding shaft 13 and the feed-out amount of the net 8 are also substantially the same and no fluctuation occurs in the tension state of the net 8. However, if the pinion 18*a* is formed with a diameter larger than the winding shaft 13, the feed-out amount of the net 8 becomes smaller than the movement amount of the winding shaft 13, and the net 8 is gradually brought into the tension state. Therefore, the diameter of the pinion and the length of the rack 30 should be set considering the final tension state of the net 8. For example, if it is so set that a portion to be excessive sag of the net 8 is wound up while the pinion 18*a* and the rack 30 are moved in the meshed state, the net 8 can be brought into the tension state without sag when the movable stile 10 has reached the fully extended end of the net 8.

Reference numeral 35 in FIGS. 2 to 4 denotes a handle used when moving the movable stile 10.

The horizontal-pulling roll screen door having the above construction is capable of setting or changing the right/left sides in opening/closing according to the door of the building opening, and when the right/left sides are to be changed from the state shown in FIGS. 1 to 5, first, the net 8 wound around the winding shaft 13 is completely withdrawn and the lock lever 27 is exposed on the opening 10*b* side of the case 10*a*. And as shown in FIGS. 5 and 7, the lock lever 27 is tilted outward so that the engagement portion 27*a* at the base end of the lever 27 is engaged with the recess portion 21*d* on the outer circumference of the intermediate support member 21, and then, the connecting cylindrical shaft 20 connected to the winding shaft 13 is brought into the state locked by the intermediate support member 21. And in this sate, the side frame 6, the net 8 and the movable stile 10 are removed from the building opening frame 2 in the integrally connected state.

After that, as shown in FIG. 9, the first cap 11 and the second cap 12 are removed from the case 10*a* in the movable stile 10 and the both ends of the winding shaft 13, but since the connecting cylindrical shaft 20 and the winding shaft 13 are locked to prevent rotation with respect to the intermediate support member 21, even if the first cap 11 and the second cap 12 are removed, the connecting cylindrical shaft 20 connected to the winding shaft 13 and the intermediate support member 21 are not relatively rotated because of the rotational urging force accumulated in the winding spring 14. Therefore, the above work can be carried out easily and safely.

Figure 10:
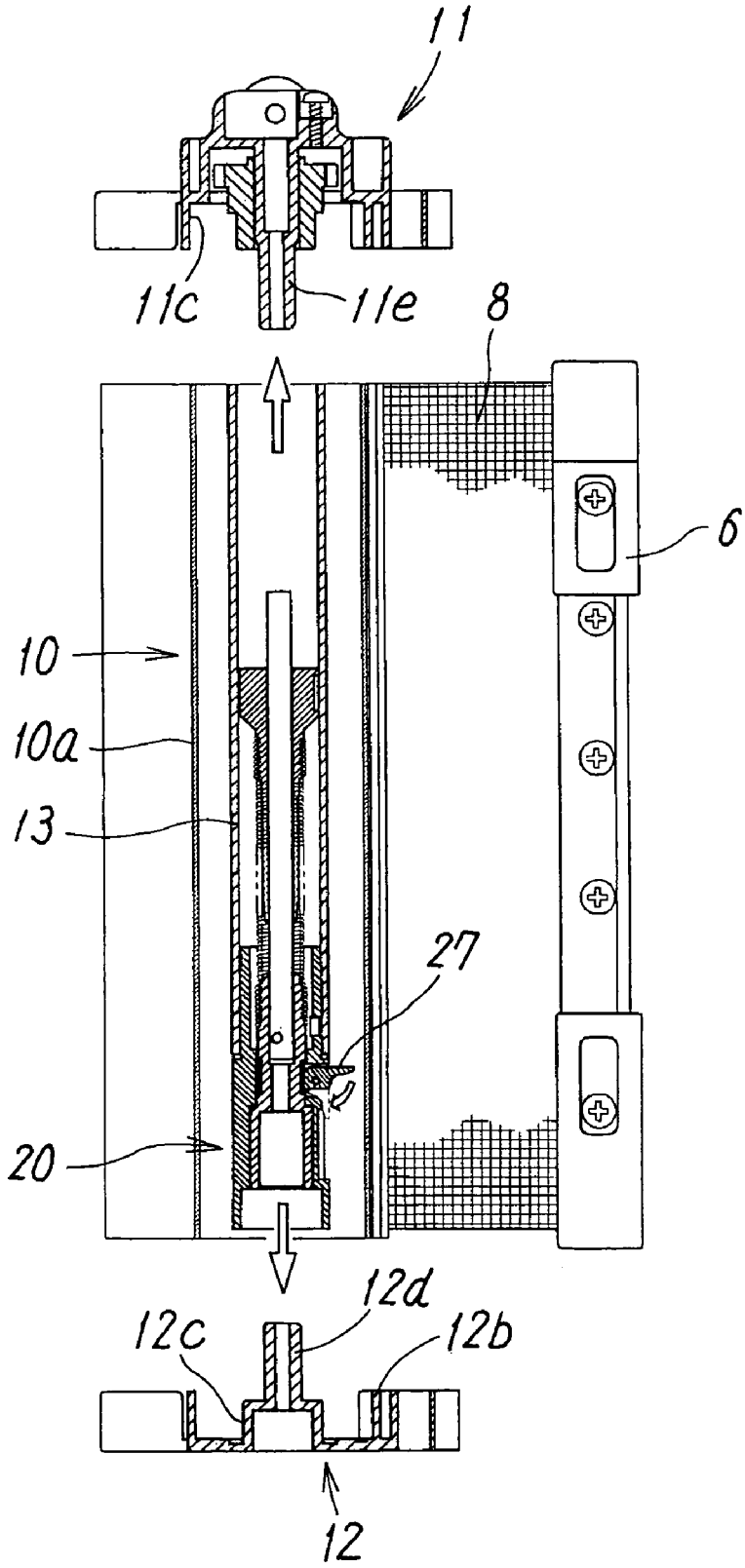
FIG. 10 is an explanatory view showing a state where the first and the second caps are replaced mounted to the both ends of a case of the vertically reversed movable stile.

Then, as shown in FIG. 10, the side frame 6, the net 8 and the movable stile 10 are reversed upside down while they are integrally connected so as to change the right/left sides, the first cap 11 and the second cap 12 are reversed in orientation and mounted at the replaced upper and the lower ends of the movable stile 10 and the side frame 6, the net 8 and the movable stile 10 with the changed right/left sides are mounted to the building opening frame 2, and then, the lock lever 27 is rotationally moved to become parallel with the winding shaft, and the locked state of the connecting cylindrical shaft 20 is released.

Therefore, the horizontal-pulling roll screen door having the above construction is capable of work to replace the first and the second caps 11, 12 at the both ends of the movable stile 10 and reverse them upside down easily and safely, by which the right/left sides of the horizontal-pulling roll screen door can be changed easily and safely without using a special tool.

In the horizontal-pulling roll screen door on the above embodiment, the upper rail 4 and the side frame 6 constituting the screen door frame are mounted to be located outside the building opening frame 2, and the lower end of the movable stile 10 is slidably engaged with the lower rail 3*a* provided at the sash lower frame 3 through the guide member 10*c*. At the same time, the lower ends of the net 8 and the movable stile 10 are brought into contact with the side face of the lower frame 3 for guiding, and with this construction, the net 8 and the movable stile 10 can be guided with a simple and inexpensive construction using the sash lower frame 3 as it is.

The invention claimed is:

1. A horizontal-pulling roll screen door, comprising:

a screen door frame having a side frame mountable on one of a pair of opening side frames forming a building opening frame and extending in a vertical direction, an upper rail mounted on an opening upper frame forming the building opening frame and extending in a lateral direction, and a movable stile having an upper end slidably supported by the upper rail such that horizontal pulling is performed on the movable stile so the stile moves between the pair of the opening side frames;

a winding shaft accommodating a coil-state winding spring therein and rotatably supported around a vertical axis of the winding shaft in the movable stile;

a net extended between the side frame and the movable stile and wound up by an urging force of the winding spring around the winding shaft such that the net can be opened/closed by a horizontal pulling of the movable stile, wherein the movable stile includes a case accommodating the winding shaft, and first and second caps supporting the winding shaft rotatably around the vertical axis of the winding shaft, the first and second caps being detachably mounted at both upper and lower ends of the case in the vertical direction such that the first and second caps are interchangeable, the first cap being slidably supported by the upper rail, the movable stile accommodates an intermediate support member mountable on the first or second cap detachably and unrotatably around the vertical axis of the winding shaft, and a connecting cylindrical shaft mounted on a first end of the winding shaft in a direction of the vertical axis of the winding shaft relatively unrotatably around the vertical axis of the winding shaft and arranged on an outer circumference of the intermediate support member, a lock mechanism is provided between the connecting cylindrical shaft and the intermediate support member such that the connecting cylindrical shaft is rotatable around a vertical axis of the intermediate support member in an unlocked state and the connecting cylindrical shaft is unrotatable around the vertical axis of the intermediate support member in a locked state, a first end of the winding spring in a direction of the vertical axis of the winding shaft is mounted on the intermediate support member unrotatably around the vertical axis of the winding shaft and a second end of the winding spring in the direction of the vertical axis of the winding shaft is mounted to the winding shaft relatively unrotatably around the vertical axis of the winding shaft, the lock mechanism has a plurality of recess portions provided on the outer circumference of the intermediate support member in a circumferential direction, and a lock lever rotatably supported by a support pin in an opening provided at the connecting cylindrical shaft between a locked position and an unlocked position, and an engagement portion is provided in the lock lever to be engaged with any of the plurality of recess portions by rotational movement of the lever to the locked position and unengaged from the plurality of recess portions by rotational movement of the lever to the unlocked position.

2. The horizontal-pulling roll screen door according to claim 1, wherein a cylinder member provided with a pinion rotated in conjunction with the winding shaft is rotatably supported by at least one of the first and the second caps, and a rack meshed with a restricting portion of the pinion of the winding shaft is added on a face opposite to the pinion in a lateral frame of the screen door frame at a portion opposite to the pinion including a fully extended state of the net or a state immediately before the fully extended state of the net.

3. The horizontal-pulling roll screen door according to claim 2, wherein the cylinder member includes a fitting portion integral with the pinion, and the fitting portion is mountable on the connecting cylindrical shaft mounted to the first end of the winding shaft or a second end of the winding shaft detachably and unrotatably around the vertical axis of the winding shaft, respectively.

4. The horizontal-pulling roll screen door according to claim 2, wherein an outer diameter of the pinion is larger than an outer diameter of the winding shaft.

5. The horizontal-pulling roll screen door according to claim 3, wherein the case of the movable stile has a constant cross-sectional shape in the direction of the vertical axis of the winding shaft, the cylinder member is rotatably supported by the first cap, the rack is added to the upper rail of the screen door frame, the first cap includes:

a head portion to which a track roller supported by the upper rail is rotatably mounted, a first connecting cylinder portion detachably mountable on either an upper end or a lower end of the case of the movable stile in the direction of the vertical axis of the winding shaft, a first shaft support portion positioned inwards of the first connecting cylinder portion and configured to rotatably support the cylinder member around the vertical axis of the winding shaft, and a first tip end shaft portion in a spline shaft state extending from a tip end of the first shaft support portion;

the second cap includes:

a second connecting cylinder portion configured to be detachably mountable on either the upper end or the lower end of the case in the direction of the vertical axis of the winding shaft, a second shaft support portion positioned inside of the second connecting cylinder portion and configured to rotatably support the second end of the winding shaft or the connecting cylindrical shaft around the vertical axis of the winding shaft, and a second tip end shaft portion in the spline shaft state and protruding from the second tip end of the second shaft support portion, and the intermediate support member is mountable on the first tip end shaft portion of the first cap or the second tip end shaft portion of the second cap detachably and unrotatably around the vertical axis of the winding shaft.

6. The horizontal-pulling roll screen door according to claim 3, wherein recess grooves are provided on an inner face of an end of the connecting cylinder shaft mounted on the first end of the winding shaft and an inner face of the second end of the winding shaft, a projection streak engageable with the recess grooves is provided on a surface of the fitting portion of the cylinder member, and the fitting portion is fittable to the end of the connecting cylindrical shaft or the second end of the winding shaft unrotatably and removably around the vertical axis of the mounting shaft.

7. The horizontal-pulling roll screen door according to claim 4, wherein recess grooves are provided on an inner face of an end of the connecting cylinder shaft mounted on the first end of the winding shaft and an inner face of the second end of the winding shaft, a projection streak engageable with the recess grooves is provided on a surface of the fitting portion of the cylinder member, and the fitting portion is fittable to the end of the connecting cylindrical shaft or the second end of the winding shaft unrotatably and removably around the vertical axis of the mounting shaft.

8. The horizontal-pulling roll screen door according to claim 5, wherein recess grooves are provided on an inner face of an end of the connecting cylinder shaft mounted on the first end of the winding shaft and an inner face of the second end of the winding shaft, a projection streak engageable with the recess grooves is provided on a surface of the fitting portion of the cylinder member, and the fitting portion is fittable to the end of the connecting cylindrical shaft or the second end of the winding shaft unrotatably and removably around the vertical axis of the mounting shaft.

9. The horizontal-pulling roll screen door according to claim 1, wherein the movable stile including the first and second caps, the net, and the side frame are constructed such that outer shapes of the movable stile are substantially vertically symmetrical.

10. The horizontal-pulling roll screen door according to claim 9, wherein a cylinder member provided with a pinion rotated in conjunction with the winding shaft is rotatably supported by at least one of the first and the second caps, and a rack meshed with the a restricting portion of the pinion of the winding shaft is added on a face opposite to the pinion in a lateral frame of the screen door frame at a portion opposite to the pinion including a fully extended state of the net or a state immediately before the fully extended state of the net.

11. The horizontal-pulling roll screen door according to claim 4, wherein recess grooves are provided on an inner face of an end of the connecting cylinder shaft mounted on the first end of the winding shaft and an inner face of the second end of the winding shaft, a projection streak engageable with the recess grooves is provided on a surface of the fitting portion of the cylinder member, and the fitting portion is fittable to the end of the connecting cylindrical shaft or the second end of the winding shaft unrotatably and removably around the vertical axis of the mounting shaft.

* * * * *